US005770812A

United States Patent [19]

Kitayama

[11] Patent Number: 5,770,812

[45] Date of Patent: Jun. 23, 1998

[54] SOFTWARE SOUND SOURCE WITH ADVANCE SYNTHESIS OF WAVEFORM

[75] Inventor: Toru Kitayama, Hamamatsu, Japan

[73] Assignee: Yamaha Corporation, Hamamatsu, Japan

[21] Appl. No.: 868,413

[22] Filed: Jun. 3, 1997

[30] Foreign Application Priority Data

Jun. 6, 1996 [JP] Japan ..... 8-165161

[51] Int. Cl.[6] ..... G10H 1/40; G10H 7/00

[52] U.S. Cl. ..... 84/603; 84/609; 84/611; 84/DIG. 12

[58] Field of Search ..... 84/603–607, 609–614, 84/634–638, DIG. 12

[56] References Cited

U.S. PATENT DOCUMENTS 5,319,151 6/1994 Shiba et al. .

FOREIGN PATENT DOCUMENTS 8-241079 9/1996 Japan .
8-328552 12/1996 Japan .
9-44160 2/1997 Japan .

*Primary Examiner*—Stanley J. Witkowski
*Attorney, Agent, or Firm*—Graham & James LLP

[57] ABSTRACT

In a method of generating musical tones through a plurality of channels according to performance information by means of a processor placed in either of a working state and an idling state and a buffer connected to the processor, control information is successively produced for the plurality of the channels according to the performance information when the same is successively inputted. A regular task of the processor is periodically instituted according to the control information for successively executing a routine synthesis of waveform samples of the musical tones allotted to the plurality of the channels and for temporarily storing the waveform samples in the buffer. It is detected when the processor occasionally stays in the idling state for instituting an irregular task of the processor to execute an advance synthesis of a waveform sample of a musical tone allotted to a particular one of the channels and for reserving the waveform sample in advance. The processor is controlled to skip the routine synthesis of the waveform sample allotted to the particular channel while loading the reserved waveform sample into the buffer. The waveform samples are sequentially read out from the buffer in response to a sampling frequency to generate the musical tones through the plurality of the channels.

18 Claims, 11 Drawing Sheets

TONE GENERATOR REGISTER

ADVANCE SYNTHESIS BUFFER SB

OUTPUT BUFFER OB

SOFTWARE SOUND SOURCE WITH ADVANCE SYNTHESIS OF WAVEFORM

BACKGROUND OF THE INVENTION

1. Field of the Invention

The present invention relates to a software sound source for generating waveform sample data of a musical tone by arithmetic operation using a general-purpose processor having an arithmetic and logic unit (ALU).

2. Description of Related Art

A conventional sound source is generally composed of a play input section in which performance information is entered from a MIDI (Musical Instrument Digital Interface), a keyboard or a sequencer, a tone generating section for generating musical tone waveforms, and a microprocessor in the form of a CPU (Central Processing Unit). The CPU performs tone generating processing such as channel assignment and parameter conversion according to the input performance information. Further, the CPU supplies the converted parameters to channels assigned by the tone generating section and issues a sounding start instruction (note-on command) to the tone generating section. The tone generating section is composed of an electronic circuit (hardware module) such as an LSI (Large Scale Integration) device to generate tone waveforms based on the supplied parameters. Consequently, the conventional sound source is specialized to the musical tone generation. Stated otherwise, the sound source composed of the hardware module must be prepared when musical tone generation is required in any application.

To overcome this problem, a software sound source has recently been proposed in which the operation of the above-mentioned musical tone generation based on the hardware module is replaced by programmed tone generation processing based on a computer program (namely, software tone generation). The CPU executes play processing in which control information is created for controlling the musical tones to be generated based on the performance information or play data such as inputted MIDI data. Further, the CPU conducts waveform synthesis processing for synthesizing waveform sample data of musical tones based on the control information generated in the above-mentioned play processing. According to the above-mentioned musical tone generating method, musical tones can be generated only by providing a DA converting chip in addition to the CPU and a program without preparing any dedicated hardware module. Further, this method allows an application program to be executed concurrently with the program for generating musical tones.

In the software sound source, the musical tone generation needs to supply a waveform sample to a DAC (Digital Analog Converter) at each sampling period, namely each conversion timing in the DAC. To meet this requirement, in the prior-art musical tone generating method, the CPU performs in normal times the play processing such as the detection of key operations. Then, the CPU performs the waveform synthesis processing at each sampling period in an interrupt manner so as to generate by arithmetic operation the waveform data for one sample of the musical tones of plural channels. Thereafter, the CPU returns to the play processing.

When the tone generation processing for each sounding channel is performed by the CPU, preparatory processing is necessary in which various register values used for the last calculation of the sounding channel are read from a memory into a corresponding CPU register. After this tone generation processing, it is also necessary to write these register values to the memory for next tone generating processing. Therefore, the tone waveform samples of the sounding channels are generated by arithmetic operation one by one, hence long calculation time is required for the preparatory processing other than the processing for generating musical tones, thereby lowering the computation efficiency, resulting in delayed response and reduced tone generation processing speeds.

In order to overcome this problem, the processing efficiency of the CPU is enhanced by performing the waveform calculation in a period longer than the sampling period. For example, the CPU performs the waveform calculation in an interrupt cycle synchronized with MIDI input, and the tone waveform thus generated by arithmetic operation is reproduced in an interrupt cycle synchronized with the sampling frequency.

In such a case, the performance information such as a MIDI event is generated in response to an operation performed by a playing person or provided from a sequencer. The thus inputted performance information is processed by the CPU. That is, when the performance information is inputted, the CPU must perform the play processing in addition to the normal musical tone waveform synthesis processing, so that irregularly inputted performance information increases the amount of the calculation, temporarily. However, in the prior-art musical tone generating method, the musical tone waveform synthesis processing is preferentially executed at regular intervals regardless of whether there is performance information or not, thereby delaying the play processing in some cases.

Besides, in a game application, for example, various programs such as an image display program not associated with music are also running in a multitask manner. Therefore, depending on how much the tasks of these programs are crowded in multitasking, the tone generation processing may not be given enough CPU processing time, resulting in discontinued musical tone reproduction in the worst case.

SUMMARY OF THE INVENTION

It is therefore an object of the present invention to provide a musical tone generating method of outputting musical tone waveforms with high stability.

The present invention provides a method of generating musical tones through a plurality of channels according to performance information by means of a processor placed in either of a working state and an idling state and a buffer connected to the processor. The method comprises the steps of successively producing control information for the plurality of the channels according to the performance information when the same is successively inputted, periodically instituting a regular task of the processor according to the control information for successively executing a routine synthesis of waveform samples of the musical tones allotted to the plurality of the channels and for temporarily storing the waveform samples in the buffer, detecting when the processor occasionally stays in the idling state for instituting an irregular task of the processor to execute an advance synthesis of a waveform sample of a musical tone allotted to a particular one of the channels and for reserving the waveform sample in advance, controlling the processor to skip the routine synthesis of the waveform sample allotted to the particular channel while loading the reserved waveform sample into the buffer, and sequentially reading the waveform samples from the buffer in response to a sampling frequency to generate the musical tones through the plurality of the channels.

Preferably, the method further comprises the step of designating the particular channel which is allotted a musical tone not so affected by the successively inputted performance information as compared to those allotted to other channels such that the reserved waveform sample of the particular channel is generally free of alteration and is normally allowed to be loaded into the buffer. Further, the step of designating comprises designating the particular channel which is allotted a musical tone of a rhythm part rather than a melody part when the performance information is successively inputted to command concurrent generation of the musical tones of parallel parts including the rhythm part and the melody part.

Preferably, the step of controlling further comprises subsequently detecting when the performance information affecting the reserved waveform sample is inputted for canceling loading of the reserved waveform sample into the buffer while instituting the regular task of the processor to execute the routine synthesis of the waveform sample allotted to the particular channel. Further, the step of subsequently detecting comprises detecting when the performance information indicative of a note-off event is inputted subsequently to a note-on event after the waveform sample allotted to the particular channel is reserved for canceling loading of the reserved waveform sample into the buffer while instituting the regular task of the processor to execute the routine synthesis of the waveform sample allotted to the particular channel.

Preferably, the inventive method further comprises the step of interruptively operating the processor to institute a multiple of tasks including the routine synthesis of the waveform sample, the successive production of the control information and other application processes not associated to the generation of the musical tones in precedence to the advance synthesis of the waveform sample such that the advance synthesis of the waveform sample is instituted unless the same conflicts the multiple of the tasks.

Preferably, the step of periodically instituting comprises successively executing the routine synthesis of the waveform samples of the musical tones allotted to the plurality of the channels in a practical order of priority such that a channel allotted a more significant musical tone precedes another channel allotted a less significant musical tone.

The above and other objects, features and advantages of the present invention will become more apparent from the accompanying drawings, in which like reference numerals are used to identify the same or similar parts in several views.

DETAILED DESCRIPTION OF THE PREFERRED EMBODIMENT

Figure 1:
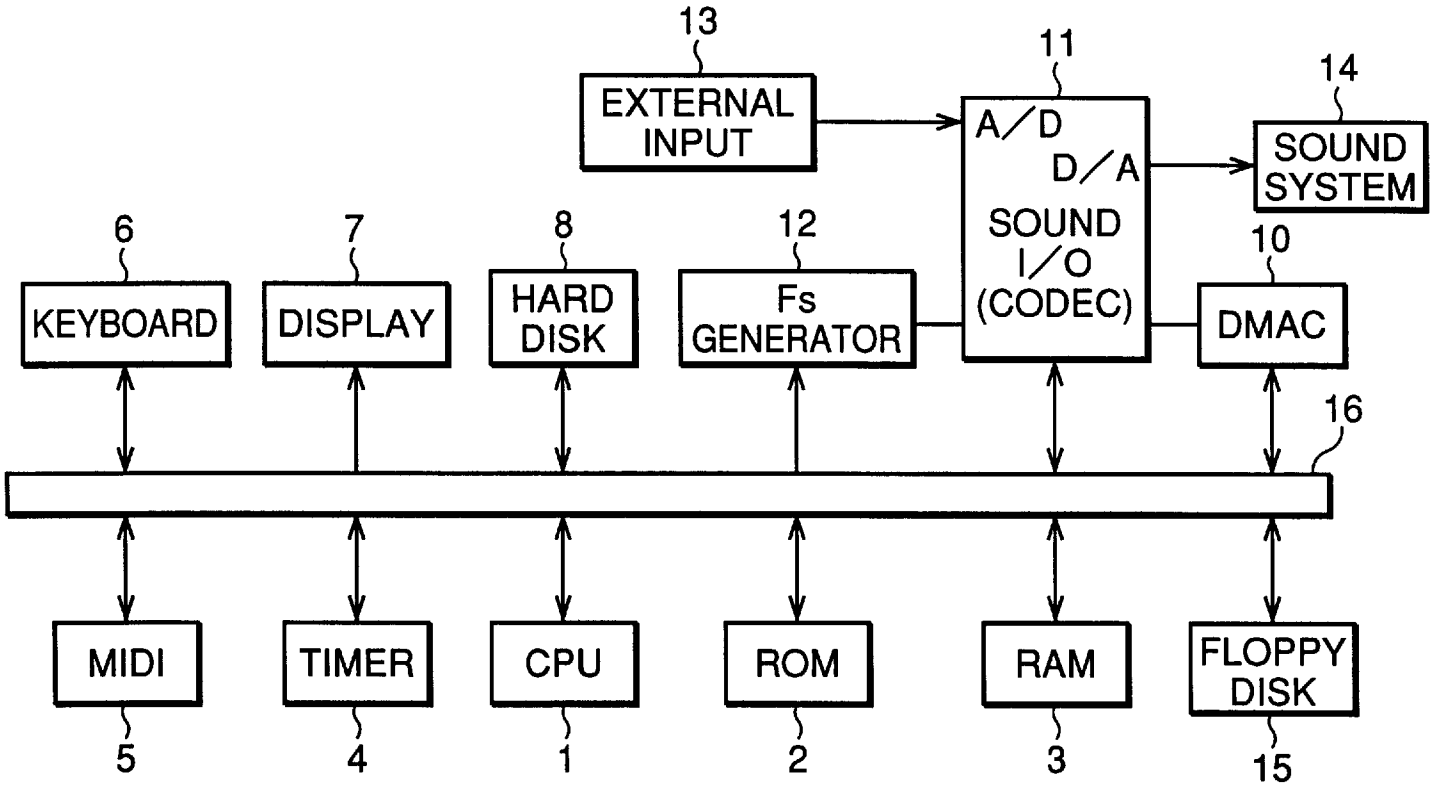
FIG. 1 is a block diagram illustrating a musical tone generating apparatus constructed to practice one preferred embodiment of the musical tone generating method according to the present invention.

This invention will be described in further detail by way of example with reference to the accompanying drawings. Now, referring to FIG. 1, there is shown constitution of the musical tone generating apparatus designed to practice one preferred embodiment of the musical tone generating method according to the present invention. In FIG. 1, reference numeral 1 denotes a central processing unit (CPU) or a microprocessor that performs various arithmetic and logic operations of an application program, and performs synthesis of musical tone waveform samples. Reference numeral 2 denotes a read-only memory (ROM) in which preset timbre data and so on are stored. Reference numeral 3 denotes a random access memory (RAM) having a work memory area provided for the CPU 1, a timbre data area, a channel register area, and an output buffer area. Reference numeral 4 denotes a timer for indicating a clock and for instructing the CPU 1 to commence timer interrupt processing. Reference numeral 5 denotes a MIDI interface into which a MIDI event is inputted and from which a generated MIDI event is outputted. Reference numeral 6 denotes a personal computer keyboard having alphabetic, kana, numeral, and symbolic keys.

Reference numeral 7 denotes a display monitor provided for a user to interact with the musical tone generating apparatus. Reference numeral 8 denotes a hard disk drive (HDD) for storing a sequencer program designed to automatically generate musical tones and for storing various application programs such as game software. The HDD 8 further stores waveform data for use in generating musical tones. Reference numeral 10 denotes a reproduction section composed of a direct memory access controller (DMAC) for directly transferring musical tone waveform sample data stored in a DMA buffer of the RAM 3 specified by the CPU 1 to a digital analog converter (DAC) provided in a sound input/output circuit (CODEC) at a certain sampling period (for example, 48 kHz) without passing this sample data through the CPU 1.

Reference numeral 11 denotes a sound input/output circuit called a CODEC (coder-decoder) incorporating a digital analog converter (DAC), an analog digital converter (ADC), an input first-in first-out (FIFO) buffer connected to the ADC, and an output FIFO connected to the DAC. This sound input/output circuit (CODEC) 11 receives in the input FIFO an audio signal coming from an external audio signal input circuit 13. The audio signal is A/D converted by the ADC according to a sampling clock of frequency Fs entered from a sampling clock generator 12. Further, the CODEC 11 operates according to the sampling clock to read out the waveform sample data written in the output FIFO of the DMAC 10, and outputs the sample data to the DAC a sample by sample. When the input FIFO has data and the output FIFO has space, the CODEC 11 outputs a data processing request signal to the DMAC 10.

Reference numeral 12 denotes the sampling clock generator for generating the sampling clock having frequency Fs, and supplies the generated clock to the sound input/output circuit 11. Reference numeral 13 denotes the external audio signal input circuit, the output thereof being connected to the ADC in the sound input/output circuit 11. Reference numeral 14 denotes a sound system which is connected to the output of the DAC in the sound input/output circuit 11. The sound system 14 amplifies an analog-converted musical tone signal outputted from the DAC at each sampling period, and outputs the amplified signal outside. Reference numeral 15 denotes a floppy disk drive. Reference numeral 16 denotes a bus for circulating data among the above-mentioned devices or components. It should be noted that an external storage device such as a CD-ROM drive or an MO (magneto-optical) disc drive other than the hard disk drive may be connected to this embodiment. The above-mentioned constitution is generally equivalent to that of an ordinary personal computer or workstation; therefore, the musical tone generating method according to the present invention may be practiced thereon.

Figure 2A:
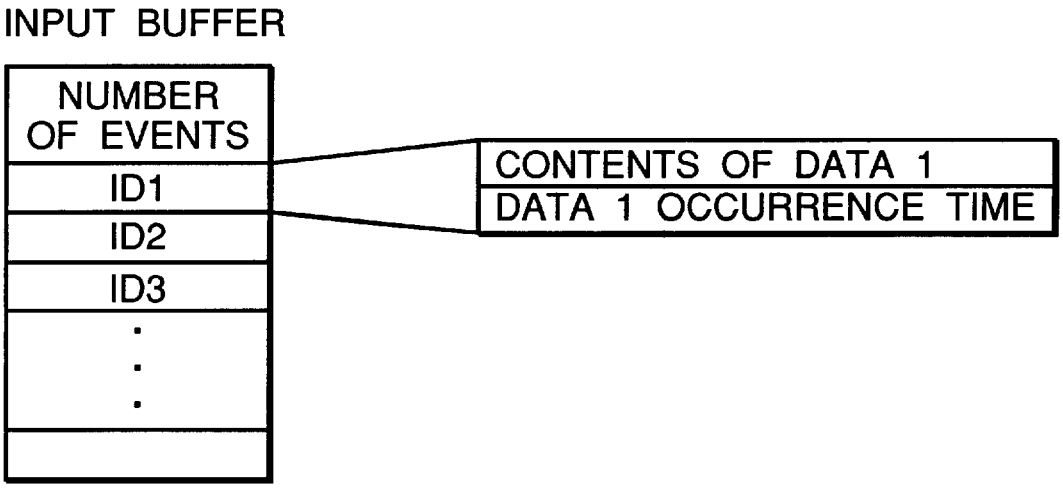
FIGS. 2(*a*)–2(*c*) are a diagram illustrating data areas provided on RAM.
Figure 2B:
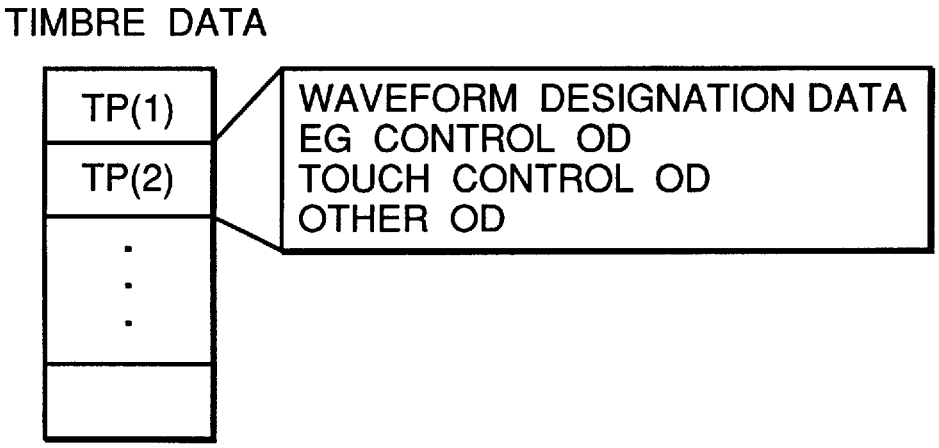
Figure 2C:
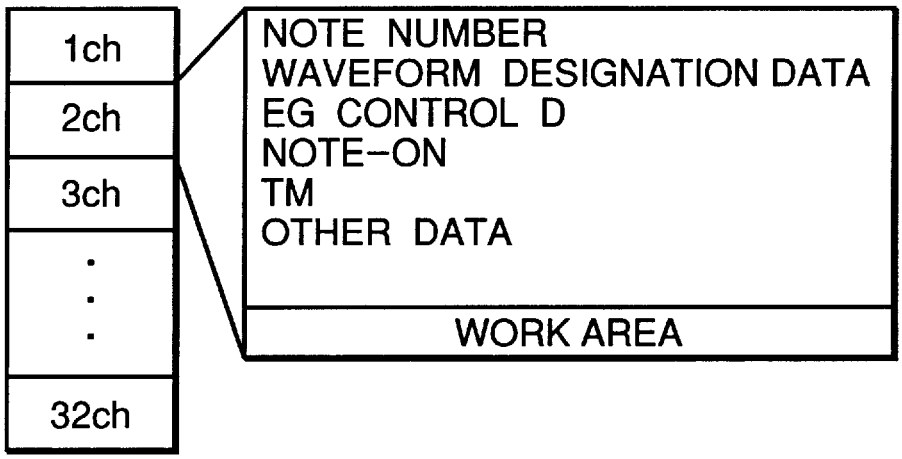

The following describes various data areas formed on the RAM 3. FIG. 2 (a) shows an input buffer into which pieces of MIDI event data ID1, ID2, ID3, and so on are written sequentially to indicate note-on and note-off. The event data may be generated by the sequencer software and game software as automatic performance information. Each piece of these MIDI event data is constituted by MIDI contents and a time stamp at which the event should occur. The time stamp can be determined by capturing the current time of the timer 4 at reception of the MIDI event data.

FIG. 2 (*b*) shows a timbre data register which holds timbre data TP(1), TP(2), and so on for determining a musical tone waveform to be generated by each MIDI channel corresponding to each play part. The timbre data includes waveform designation data for designating a waveform table of a desired timbre, LFO (Low Frequency Oscillator) control data to be used when providing vibrato and other effects, FEG control OD data for controlling generation of a filter envelope according to desired timbre filter characteristics, AEG control OD data for controlling generation of an amplitude envelope for amplitude control, touch control OD data for controlling a key touch to alter musical tone attack velocity, and other OD data. It should be noted that OD herein denotes original data. Actual data used by the tone generator is created by processing these original data according to touch data and pitch data inputted at the time of music play.

FIG. 2 (*c*) shows a tone generator register which holds data for determining a musical tone waveform to be generated by each sounding channel. In this example, a memory area for 32 channels (1*c*h through 32*c*h ) is provided in this register. The area for each channel contains a note number, waveform designation data indicating a waveform table address, LFO control data (LFO control D), filter envelope control data (FEG control D), amplitude envelope control data (AEG control D), note-on data, timing data (TM), and other data (other D). The tone generator register further includes a work area to be used by the CPU 1 for program execution. These waveform designation data, LFO control D, FEG control D, and AEG control D are obtained by processing the above-mentioned original data OD.

Figure 3A:
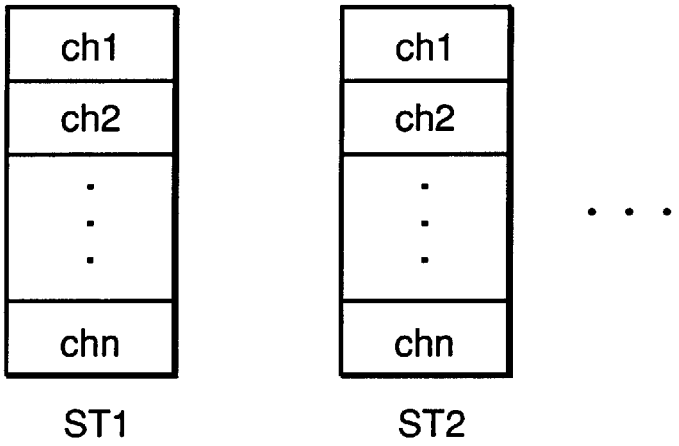
FIGS. 3(*a*) and 3(*b*) are a diagram illustrating buffer areas provided on RAM.
Figure 3B:
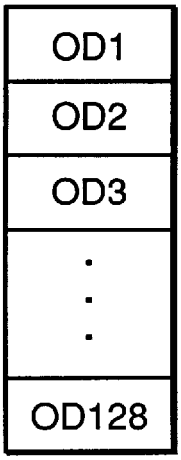

FIG. 3 (*a*) shows an advance synthesis buffer SB. In the musical tone generating method according to the present invention, the advance synthesis of musical tone waveform samples is performed by using a CPU idle time. This advance synthesis buffer SB holds the musical tone waveform samples thus generated in advance. To be specific, the advance synthesis buffer SB holds, for each of the sounding channels, the musical tone waveform samples. In this example, 128 samples are prepared at one frame for each of sounding channels (ch1 through chn). Each of frames are denoted by ST1, ST2, and so on. The advance-synthesized musical tone waveform samples are stored a frame by frame by using management data that indicates correspondence between the advance-synthesized musical tone waveform samples of particular sounding channel and the frame ST in the advance synthesis buffer SB. An area large enough for holding the waveform data for the sounding channels indicated by the management data is prepared in the advance synthesis buffer SB. This constitution can prevent setting of unnecessary area for channels that are not subjected to the advance synthesis.

FIG. 3 (*b*) shows an output buffer OB which provides musical tone waveform data storage areas OD1 through OD128 for 128 samples which have been generated by arithmetic operation. This output buffer OB holds the musical tone waveform data obtained by sequentially adding the musical tone waveform sample data of 32 sounding channels generated by the arithmetic operation at the maximum. In the arithmetic operation of the waveform data, the musical tone waveform samples (128 samples) are collectively generated at one frame for each channel. This operation is repeated by the number of times corresponding to the number of channels being sounded (the maximum of 32 channels). Every time the musical tone waveform data of one channel is generated by the arithmetic operation, this musical tone waveform data is added to the previous musical tone waveform data stored in the output buffer OB.

The size of the output buffer OB can be set to 100 words,500 words, 1K words, or 5K words. It will be apparent that as the size gets larger, longer sounding delay is caused. On the other hand, as the size gets smaller, the response goes down upon temporary increase in the amount of the arithmetic operation. Therefore, the size of the output buffer can be made large for automatic playing such as sequencer playing that requires no real-time operation, because play timing can be shifted forward to absorb the sounding delay. For manual playing such as keyboard playing requiring real-time operation, the buffer size is suitably set for 100 to 200 samples to prevent delayed sounding from occurring. The above-mentioned buffer size determination applies to the case in which the reproduction sampling frequency is 40 kHz to 50 kHz. Lowering the sampling frequency requires to set the buffer size to a smaller level to prevent delayed sounding from occurring.

The musical tone generating method according to the present invention is practiced by the processing unit thus constituted. In the present embodiment, MIDI processing is performed for generating musical tone control information based on the performance information in the form of MIDI events every time these MIDI events are inputted. Further, the waveform synthesis processing is performed for collectively generating by arithmetic operation the musical tone waveform samples for each sounding channel at one frame based on the musical tone control information provided for every predetermined calculation time corresponding to one frame. The musical tone waveform samples generated by arithmetic operation through the waveform synthesis processing are stored in the output buffer OB, and are then transferred to the DMA buffer controlled by the reproduction section (DMAC) 10. The samples are read from the DMA buffer one by one at each sampling period. The read samples are then supplied to the DAC to be sounded from the sound system 14.

The above-mentioned waveform synthesis processing is not only started for each frame but also started when an idle time is detected in the processing by the CPU 1. Using this idle time, the advance synthesis of musical tone waveform samples is performed. Thus, even if a predetermined calculation time has not been reached, the musical tone waveform samples for a succeeding frame can be synthesized by arithmetic operation in advance by using this CPU idle time, thereby preventing temporary competition among parallel processes from occurring. This in turn prevents the musical tone waveform synthesis from being delayed too much.

The timings of the above-mentioned operation in the present embodiment will be described with reference to FIG. 8. In this figure, the lateral axis represents time. As described before, the arithmetic operation for waveform synthesis is performed in units of one frame containing 128 samples in the musical tone generating method according to the present invention. In this figure, three consecutive frames are represented by a duration Ta from time ta to time tb, a duration Tb from time tb to time tc, and a duration Tc from time tc to time td.

Figure 8:
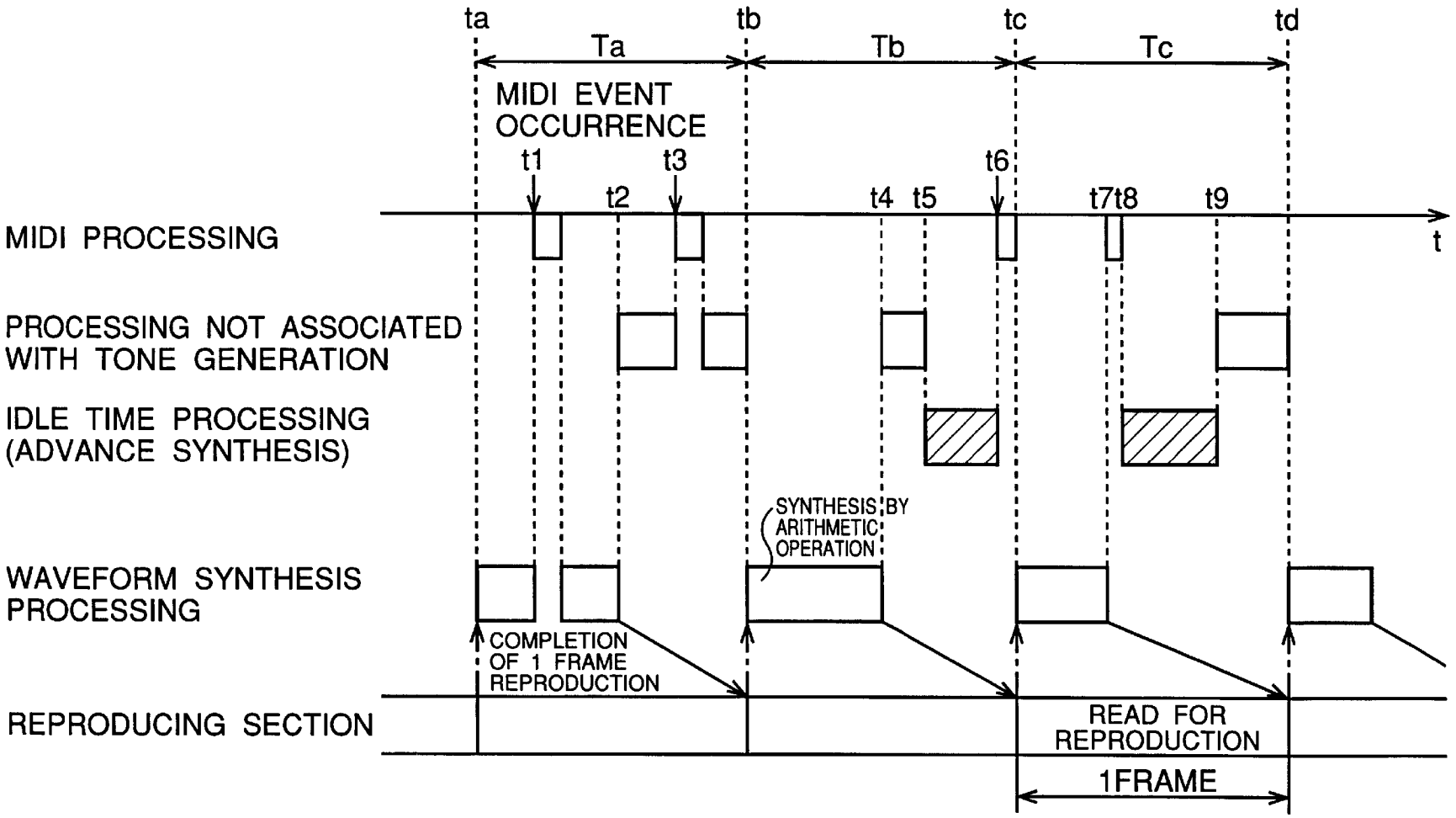
FIG. 8 is a timing chart showing operation of the musical tone generating method according to the present invention.

The top row in FIG. 8 indicates timings at which a software interrupt is caused when a MIDI event is inputted from an application program such as game software or sequence software. In the example shown in this figure, the software interrupt due to the MIDI event is caused at time t1 and t3 in the duration Ta and at time t6 in the duration Tb. The next row indicates a timing at which the MIDI processing is performed. As shown, this MIDI processing is performed every time the software interrupt due to the MIDI event is caused. The bottom row indicates a manner by which musical tone waveform samples are read and reproduced by the reproduction section 10. As shown, every time the musical tone waveform samples for one frame have been outputted, a one-frame reproduction complete interrupt is caused. This is indicated by the upward arrows at times ta, tb, tc, and td. In response to this interrupt, the waveform synthesis processing is started. The musical tone waveform samples generated by arithmetic operation in this waveform synthesis processing are transferred to the DMA buffer at the end of the waveform synthesis by arithmetic operation, and are read out for reproduction by the reproducing section at the next frame period.

The arithmetic operation for waveform synthesis for the first MIDI event inputted in the first duration Ta is performed in the second duration Tb, and the musical tone waveform samples generated by this arithmetic operation are read out in the third duration Tc for reproduction. Therefore, a time lag of about two frames occurs from the inputting of playing operation in the form of a MIDI event to the actual generation of the musical tone. Since one frame is about 2.67 ms when the sampling frequency is 48 kHz provided that one frame is composed of 128 samples, such a time lag is negligible.

In FIG. 8, the second row below the first row of the MIDI processing represents the timing at which the processing other than that associated with music is executed. As described before, in the processor in which the musical tone generating method according to the present invention is executed, the processing other than that associated with musical tone generation can be executed concurrently. As shown in the figure, the execution of the processing not associated with musical tone generation starts at the termination of the waveform synthesis processing at time t2. In the example of FIG. 8, the processing not associated with musical tone generation is executed up to time t5 while being interrupted by the MIDI processing and the waveform synthesis processing halfway.

Referring to FIG. 8, the third row below the second row of the processing not associated with musical tone generation represents idle time processing. The idle time processing has the lowest priority. Namely, this processing is executed when none of the MIDI processing, the waveform synthesis processing, and the processing not associated with musical tone generation is executed. In this example, the idle time processing is executed during an interval after the end of the processing not associated with musical tone generation at time t5 and before calling of the MIDI processing at time t6, and during another interval after the end of the MIDI processing at time t8 and before calling of the processing not associated with musical tone generation at time t9. In the idle time processing, the advance synthesis of musical waveform is executed.

In execution priority, the MIDI processing and the waveform synthesis processing come first, followed by the processing not associated with musical tone generation and the idle time processing in this order. Consequently, if a one frame complete interrupt or a MIDI event occurrence interrupt is caused during execution of the MIDI processing or the waveform synthesis processing, the processing being executed is suspended and the next processing responsive to the interrupt is started. For example, in FIG. 8, if a software interrupt is caused at time t1 during execution of the waveform synthesis processing for a hardware interrupt caused at time ta, the MIDI processing for that MIDI event is executed. When, this MIDI processing comes to an end, the suspended waveform synthesis processing is resumed. In another example, if a hardware interrupt is caused by the reproducing section 10 at time tc when the MIDI processing for a software interrupt caused at time t6 is being executed, the MIDI processing is suspended and the waveform synthesis processing is executed. When this waveform synthesis processing comes to an end at time t7, the suspended MIDI processing is resumed. In still another example, if a MIDI event occurs at time t3 during execution of the processing not associated with musical tone generation, the same is suspended and the MIDI processing is executed. When the MIDI processing comes to an end, the suspended processing is resumed.

For summary, the inventive music apparatus generates musical tones through a plurality of channels according to performance information. In this apparatus, an input device including the keyboard 6 and the MIDI 5 successively produces control information prepared for the plurality of the channels according to the performance information when the same is successively inputted. A processor in the form of CPU 1 is placed in either of a working state and an idling state and periodically institutes a regular task in the working state according to the control information to successively execute a routine synthesis of waveform samples of the musical tones allotted to the plurality of the channels. A buffer memory in the form of RAM 3 is connected to the processor and temporarily stores the waveform samples formed by the routine synthesis. A detector detects when the processor occasionally stays in the idling state and then triggers the processor to institute an irregular task effective to execute an advance synthesis of a waveform sample of a musical tone allotted to a particular one of the channels so that the waveform sample can be reserved in advance. A controller controls the processor to skip the routine synthesis of the waveform sample allotted to the particular channel while loading the reserved waveform sample into the buffer memory. An output device including DMAC 10 and CODEC 11 sequentially reads the waveform samples from the buffer memory in response to a sampling frequency to generate the musical tones through the plurality of the channels. Preferably, the music apparatus further comprises a designator that designates the particular channel which is allotted a musical tone not so affected by the successively inputted performance information as compared to those allotted to other channels such that the reserved waveform sample of the particular channel is generally free of alteration and is normally allowed to be loaded into the buffer memory. Further, the controller comprises a detector that subsequently detects when the performance information affecting the reserved waveform sample is inputted for canceling loading of the reserved waveform sample into the buffer memory while instituting the regular task of the processor to execute the routine synthesis of the waveform sample allotted to the particular channel.

Figure 4A:
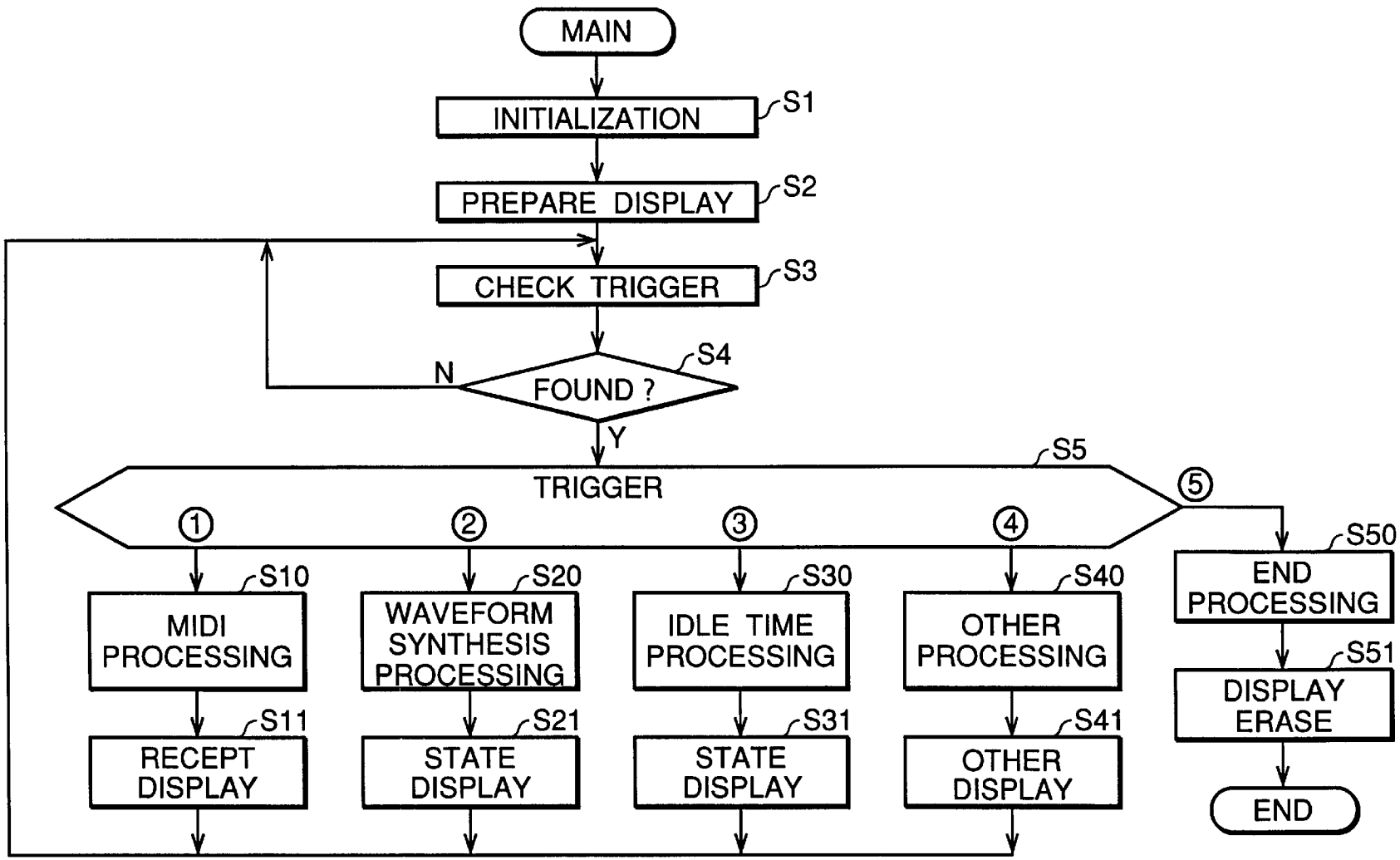
FIGS. 4(*a*) and 4(*b*) are a flowchart describing the musical tone generating method according to the present invention.
Figure 4B:
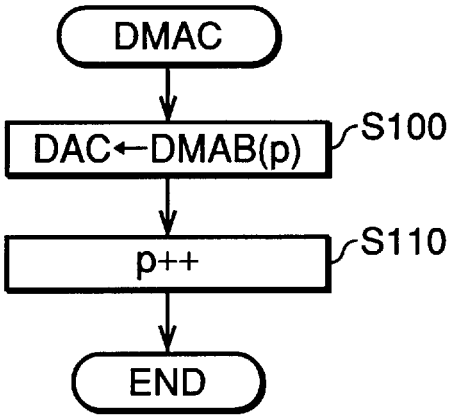

The following describes details of the musical tone generating method according to the present invention. FIG. 4 (*a*) shows a flowchart of the main routine. When this software sound source is started, initialization including allocation of various buffers on the RAM 3 is performed in step S1. In step S2, a display screen for this software sound source is prepared. In step S3, check is made to find whether any trigger has occurred or not. In step S4, it is determined whether there is a trigger or not. If a trigger is found, the process goes to step S5. If not found, the process goes back to step S3 to wait for occurrence of a trigger.

If a trigger is found, the type thereof is determined in step S5 for starting corresponding processing. The triggers include: (1) occurrence of a MIDI event from sequencer software or the like; (2) completion of the reproduction of the waveform samples for one frame; (3) detection of CPU idle time; (4) various requests such as panel input and command input; and (5) an end request by end command input or the like.

The occurrence of a MIDI event from the sequencer software is notified to the CPU 1 as a software interrupt. On the other hand, the completion of reproduction for one frame is notified as a hardware interrupt caused by the sound input/output circuit 11 or the DMAC 10. The various requests and the end command input are issued by the user by means of the keyboard 6, an operator panel, or a window screen of the display 7. The software and hardware interrupts precede to the user operation input, and therefore the processing operations corresponding to the above-mentioned triggers (1) and (2) are preceded in execution to the processing operations corresponding to the triggers (4) and (5).

Figure 5A:
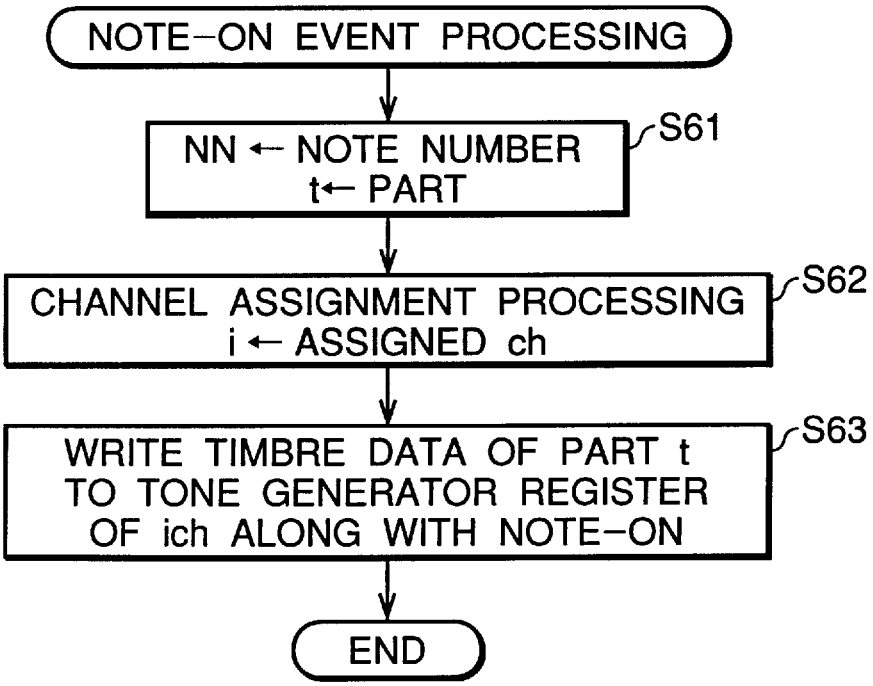
FIGS. 5(*a*) and 5(*b*) are a flowchart describing MIDI processing according to the present invention.
Figure 5B:
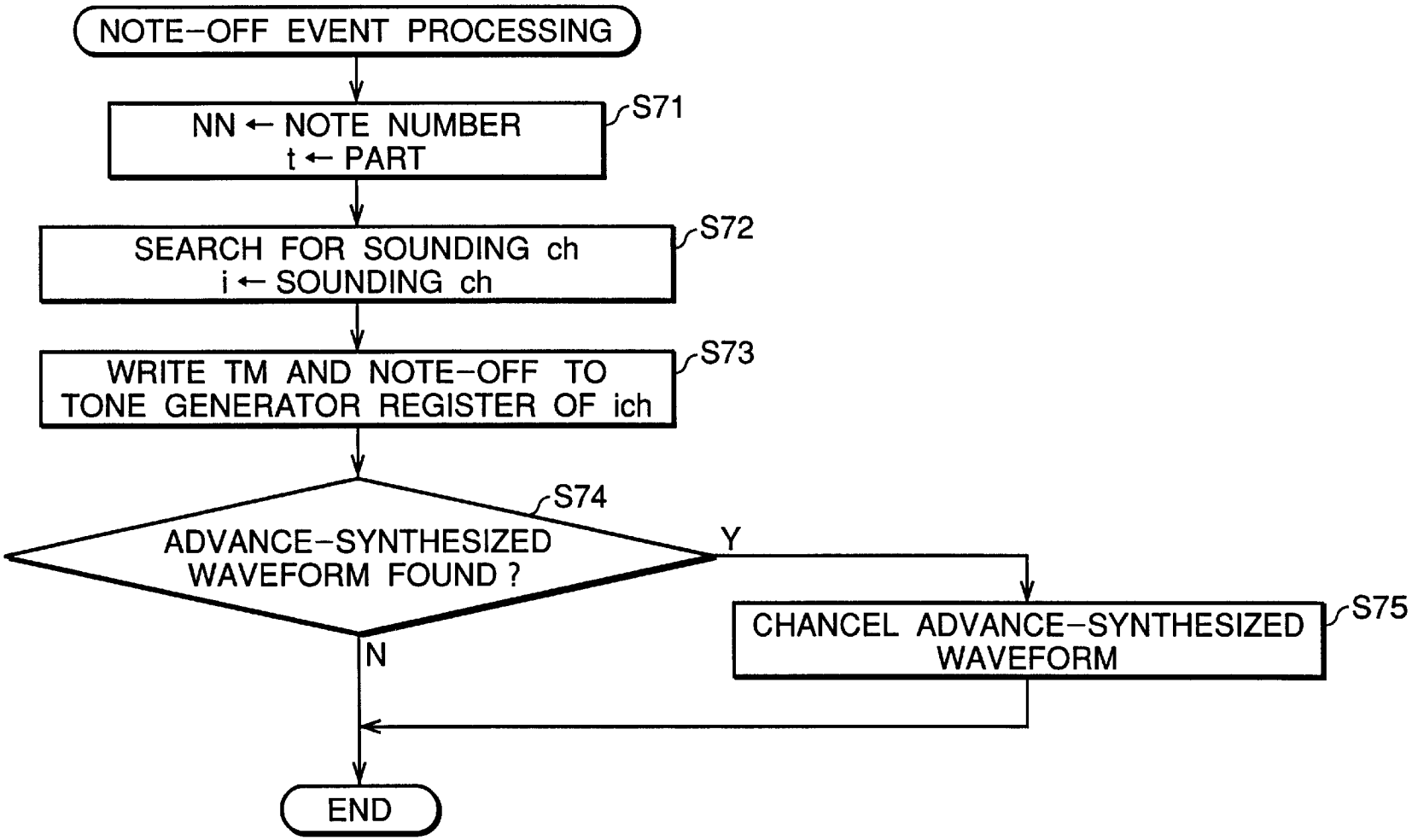

If the trigger (1) or the occurrence of a MIDI event is found in step S5, the MIDI processing of step S10 is executed. In this MIDI processing, note-on, note-off, program change, control change, or system exclusive processing is executed corresponding to the MIDI event generated from the application program such as sequencer software or game software that produces musical tones. For example, if the MIDI event is a note-on event, the note-on event processing is executed. The flowchart for this note-on event processing is shown in FIG. 5 (*a*). As shown, when the note-on event processing starts, a note number of the note-on event data and timbre data of a concerned part are stored in an NN register and a t register, respectively in step S61. Next, in step S62, a sounding channel that sounds a musical tone associated with this note-on event is assigned from among the 32 channels, and the number i of the assigned channel is stored in a register. In step S63, the data obtained by processing timbre data TP(t) corresponding to the MIDI channel that receives this note-on event according to the values of the note number NN and velocity VEL is written into the sound source register corresponding to the assigned sounding channel i along with note-on indicating data and a time stamp TM indicating tone generation timing.

If the inputted MIDI event is a note-off event, the note-off event processing shown in FIG. 5 (*b*) is executed. When the note-off event processing starts, in step S 71, the note number of this note-off event is registered in the NN register, and search is made for a currently sounding channel specified by that note number NN. The number i of that channel is registered in a register in step S72. Then, in step S73, the generation time stamp TM of this note-off event and note-off indicating data are written into the tone generator register of the i channel. In step S74, it is determined whether the musical tone waveform samples for the channel i have been generated in advance. If a advance-synthesized musical tone waveform is found, cancel processing for this advance-synthesized musical tone waveform is executed in step S75. The cancel processing is executed because, if a note-off event occurs, the waveform of that sounding channel must be altered to regenerate the musical tone waveform suitable after the note-off. As described before, the advance synthesis buffer SB holds the advance-synthesized musical tone waveform for each sounding channel at each reserved frame ST, so that canceling can be performed with ease only for the musical tone waveform corresponding to the sounding channel which receives the note-off event. It should be noted that this cancel processing is executed not only in the note-off event processing but also when a musical tone control event requiring change of the musical tone waveforms after starting sounding occurs in expression event processing for example.

When the MIDI processing of step S10 has been executed, the process goes to step S1, in which information that the MIDI event has been received is indicated on the display device 7. Then, the process goes back to step S3 to wait for occurrence of a next trigger.

If the detected trigger is the trigger (2) or the completion of reproducing the waveform samples for one frame, the waveform synthesis processing of step S20 is executed. This waveform synthesis processing simulates function of a hardware sound source. To be specific, this processing collectively generates by arithmetic operation the musical tone waveform samples for one frame period based on the sounding control information generated in the above-mentioned MIDI processing, and stores the generated waveform samples in the output buffer.

Figure 6:
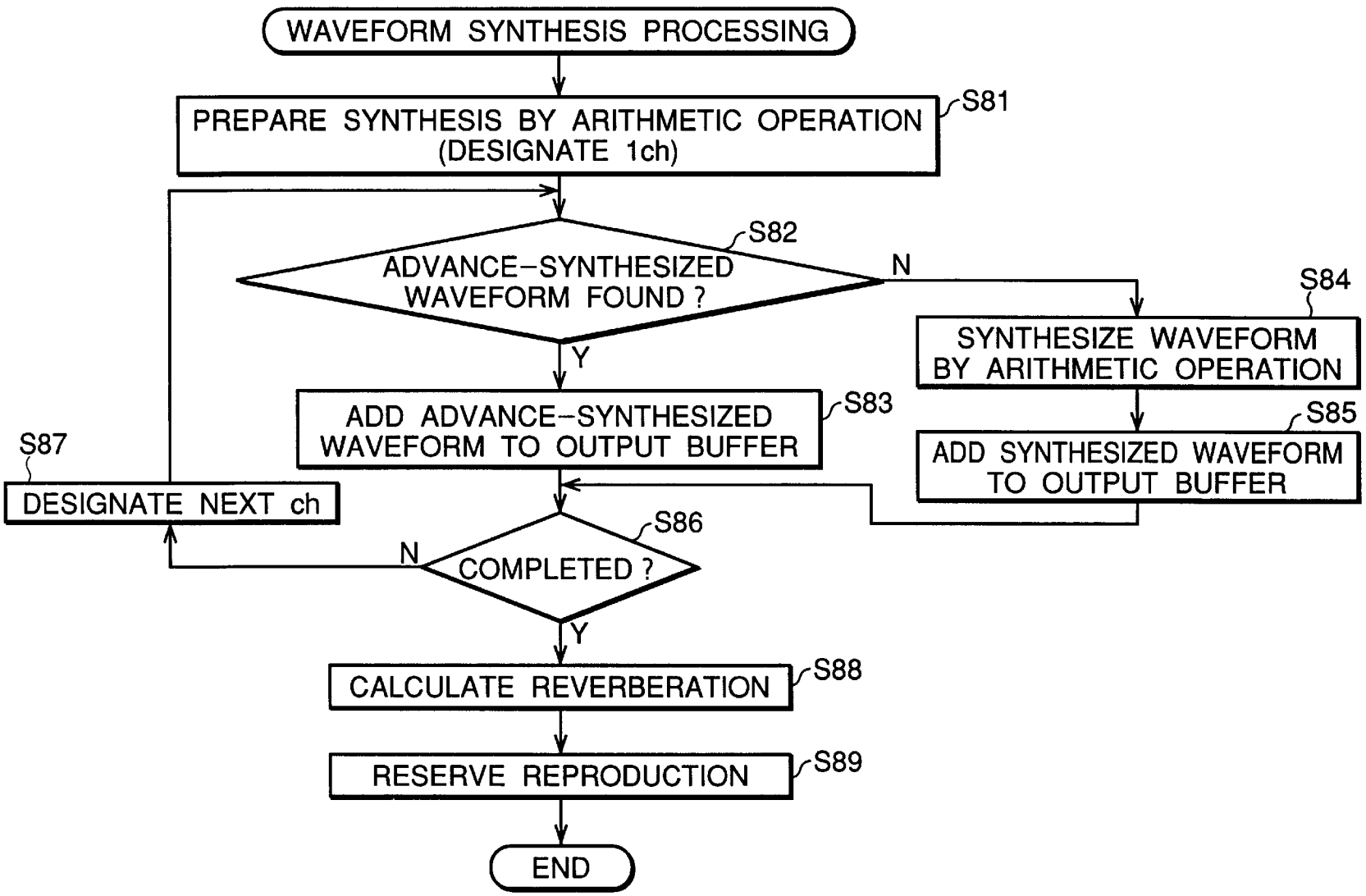
FIG. 6 is a flowchart describing waveform synthesis processing according to the present invention.

FIG. 6 shows a flowchart of the waveform synthesis processing. When the waveform synthesis processing (step S20) starts, preparations for the arithmetic operation to generate the first musical tone waveform sample for the first sounding channel are performed in step S81. When the musical tone waveform samples are generated by arithmetic operation by the CPU, occasionally the CPU time for the waveform synthesis may decreased by interrupts from other processing, thereby possibly delaying too much the supply of the musical tone waveform samples for all sounding channels. To overcome this problem, when generating by arithmetic operation the musical tones for a plurality of sounding channels, the sounding channels are ordered such that primary sounding channels of greater significance are treated before secondary sounding channels having less significance are treated. The sounding channels of greater significance include those channels which are high in sounding level, short in time from the start of sounding and those channels sounding the highest tone or lowest tone when a plurality of parts are being played or those playing a solo part. The sounding channel having the highest priority is first treated according to the above-mentioned priority order.

The above-mentioned preparations for the arithmetic operation include accessing the data such as the last read address, various EG values, attack and release status of the EG values, and LFO (Low Frequency Oscillator) values, and include loading of these data into the internal registers of the CPU 1. Next, in step S82, it is determined whether there is advance-synthesized musical tone waveform sample of a concerned sounding channel. If this sounding channel is subjected to the advance synthesis and the corresponding musical tone waveform is held in the advance synthesis buffer SB, the process goes to step S83, in which the musical tone waveform sample held in the advance synthesis buffer SB (of frame ST1) is added to the output buffer OB. Thus, no routine waveform synthesis by arithmetic operation is performed, hence the processing for that sounding channel ends in a very short time. On the other hand, if no advance-synthesized waveform is held in the buffer SB, the process goes to step S84, in which the routine waveform synthesis by arithmetic operation is performed. To be specific, the waveform calculation of LFO, filter EG (FEG), and amplitude EG (AEG) are performed to generate the samples of LFO waveform, FEG waveform, and AEG waveform necessary for the arithmetic operation at one frame. The LFO waveform is added to the F number, the FEG waveform, and the AEG waveform to be used for modulating each piece of data. Then, the F number is repeatedly added with the last read address used as the initial value to generate the read address of each waveform sample in one frame. Based on the integer part of this read address, the waveform samples are read from the waveform storage area in the timbre memory. At the same time, based on the fractional part of this read address, interpolation is performed between the read waveform samples to calculate all interpolated sample values within one frame. If one frame is equivalent to the time for 128 samples, the processing for 128 samples is executed collectively. Then, timbre filter processing is executed for performing timbre control based on the FEG waveform on the interpolated samples for one frame. Thereafter, amplitude control processing is executed and volume data and volume data on each of the filtered samples. Next, in step S85, accumulation write processing is executed in which the amplitude-controlled musical tone waveform samples for one frame generated by arithmetic operation in step S84 are added to the corresponding samples held in the output buffer OB.

After step S83 or step S85, it is determined in step S86 whether the processing of all sounding channels has completed or not. If the processing has not been completed, the sounding channel to be treated next is specified in step S87 and the process goes back to step S82. If the processing has been completed, the routine goes to step S88. At this moment, the accumulated values of the musical tone waveform samples generated by arithmetic operation for all sounding channels are held in the output buffer OB as the final musical tone waveform samples for one frame. In step S88, effects processing such as reverberation calculation is executed according to the setting by the user. Then, in step S89, the musical tone waveform samples provided with reverberating effect and held in the output buffer OB are reserved for reproduction. This reservation is performed by transferring the contents of the output buffer to one of two DMA buffers that currently holds no musical tone waveform.

Figure 7:
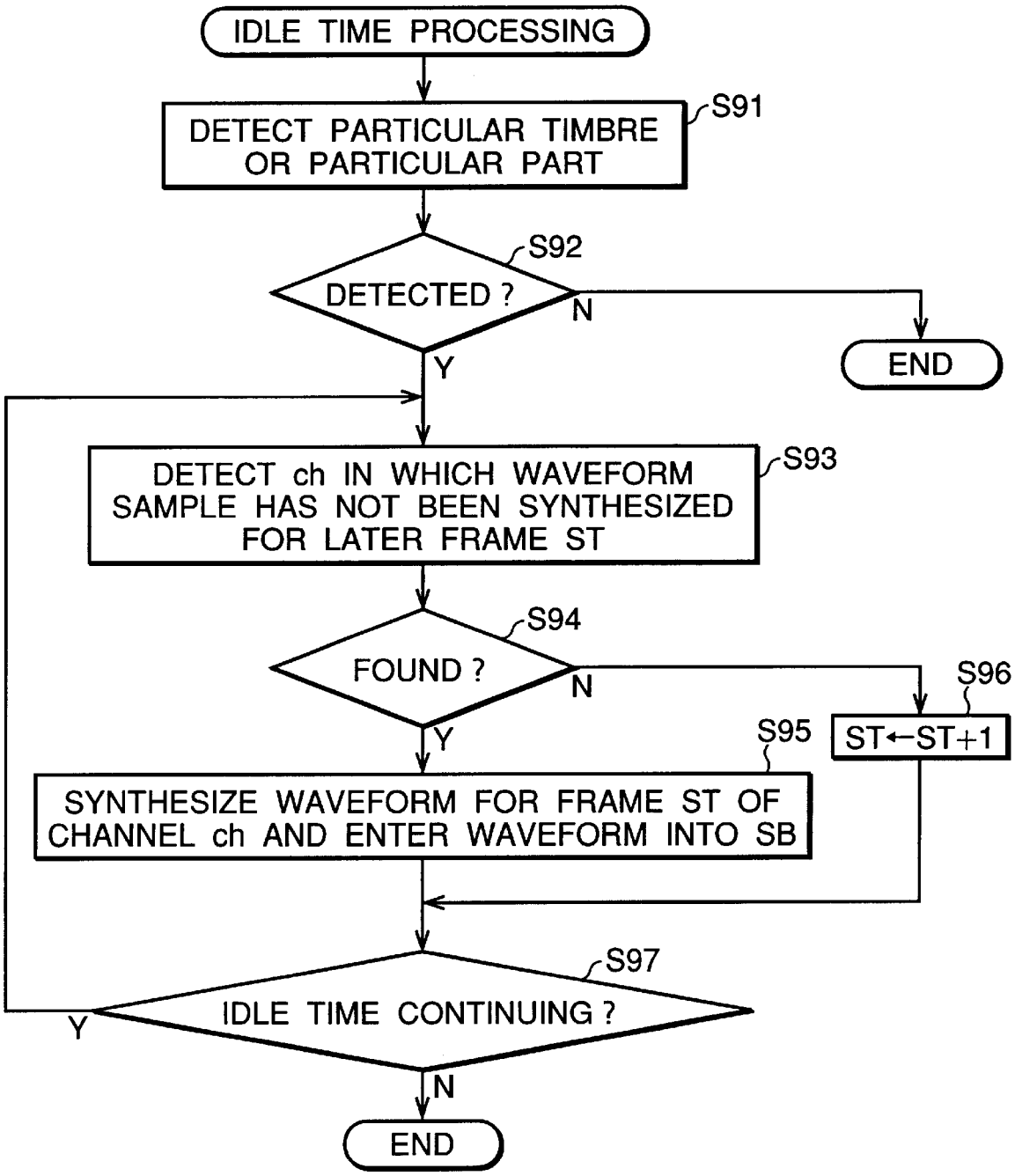
FIG. 7 is a flowchart describing idle time processing according to the present invention.

If, in step S5, the trigger is the detection of an idle time in the CPU processing, the idle time processing of step S30 is executed. A flowchart of this idle time processing is shown in FIG. 7. When the idle time processing starts, it is detected in step S91 whether a particular timbre or a particular part is sounded or not. Because the timbre or part having a low probability of generating a musical tone control event such as a note-off event after start of sounding is suitable for the advance synthesis of musical tone waveform samples, the above-mentioned detection is made to determine whether such a timbre or part is found in currently sounding channels or not. For example, in a drum part of a marimba timbre, it is very seldom that a musical tone control event such as the note-off event is generated after start of sounding. For a sounding channel to which such a timbre is assigned, if a musical tone waveform sample is generated in advance, the generation sample is seldom canceled later. On the other hand, in case of a timbre of a melodic sound such as trumpet or piano, events such as a note-off event and an expression event are often generated. For such timbres, it is highly probable that the advance-synthesized musical tone waveform samples must be canceled. Therefore, in the present embodiment, advance synthesis is performed preferentially with those sounding channels which generate musical tones that seldom receives musical tone control events such as a note-off event after start of sounding. Consequently, as a result of the determination of step S92, if the timbre or part seldom receiving musical tone control events such as a note-off event after start of sounding is not found in the currently sounding channels, the idle time processing comes to an end without performing advance synthesis.

On the other hand, if the above-mentioned timbre or part is found sounding, the process goes to step S93. In step S93, a channel is detected in which the musical tone waveform sample assigned to a later frame ST has not yet been generated. A frame ST1 indicates a frame following the currently sounding frame, and ST2 indicates a frame next to the frame ST1. As a result of this determination, if a channel is found in which the musical tone waveform sample to be assigned to the later frame ST has not yet been generated, the process goes to step S95. In step S95, the musical tone waveform for the later frame ST of that channel is generated. Then, the generated waveform is stored in the area of the advance synthesis buffer SB assigned to the corresponding later frame. It should be noted that this advance synthesis by arithmetic operation is performed in the same manner as the above-mentioned routine waveform synthesis processing. If the decision is NO in step S94, the later frame ST is incremented by one in step S96.

After step S95 or step S96, the process goes to step S97 to determine whether the idle time still continues. If the idle time still continues, the process goes back to step S93 to execute the above-mentioned processing. If another task has taken place and there is no idle time, the present processing comes to an end. Then, in step S31 (FIG. 4(*a*), the results of this idle time processing are displayed and the process goes back to step S3 to wait for a trigger to occur.

In step S5, if the trigger is found with respect to the processing not associated with musical tone generation, the process goes to step S40, in which the corresponding processing is executed. The processing includes various setting and selecting of the number of sounding channels and the number of sampling frequencies of the software sound source in response to an operator panel operation and command input by the user, and includes setting of the capacity of the output buffer equivalent to one frame and various effects. The results of these operations are displayed in step S41 and then the process goes back to step S3.

If the determination of step S5 is the input of an end command, the process goes to step S50, in which end processing is executed. Then, in step S51, the display screen for this software sound source is erased to terminate the processing for the software sound source.

FIG. 4 (*b*) shows a flowchart describing the operation of the DMAC 10. As described earlier, if a space is found in the FIFO of the CODEC 11, an interrupt is caused to the DMAC 10 to activate the same. When the DMAC 10 is activated, the process goes to step S100, in which musical tone waveform sample data is read from the DMA buffer at the address specified by the content p of a pointer register, and the read data is transferred to the above-mentioned FIFO. Then, in step S1 10, the content p of the pointer register is incremented to end this processing. Thus, every time a space occurs in the FIFO, the musical tone waveform sample data is transferred from the DMA buffer to the FIFO. According to the sampling clock generated by the sampling clock generator 12, the musical tone waveform samples are outputted from the FIFO to the DAC.

It should be noted that the constitution of the advance synthesis buffer SB is not limited to the above-mentioned constitution. It will be apparent that the advance synthesis buffer SB may take any constitution as long as the same can store the musical waveform sample generated in advance. In the present embodiment, the software interrupt caused by a MIDI event and the hardware interrupt caused by completion of one frame reproduction are the same in priority. It will be apparent that these interrupts do not necessarily have the same priority. For example, the interrupt by MIDI event may precede to the interrupt by completion of one frame reproduction. This priority setting may provides more efficient processing since the MIDI processing ends in a shorter time than the waveform synthesis processing. The temporal flows of the processing described with respect to the above-mentioned embodiment are nothing but an example. It will be apparent that arrangement of frame size, MIDI event, waveform synthesis processing, and reading for reproduction may be different from those mentioned above. In the above-mentioned embodiment, the waveform synthesis processing is activated by the interrupt caused by completion of one frame reproduction. It will be apparent that the waveform synthesis processing may also be activated automatically after the activation of the MIDI processing by the occurrence of a MIDI event. It will also be apparent that musical tone generating is not limited to the above-mentioned waveform table mode. For example, musical tone generating may be based on any of FM, physical modeling, and ADPCM (Adaptive Differential Pulse Code Modulation).

Figure 9:
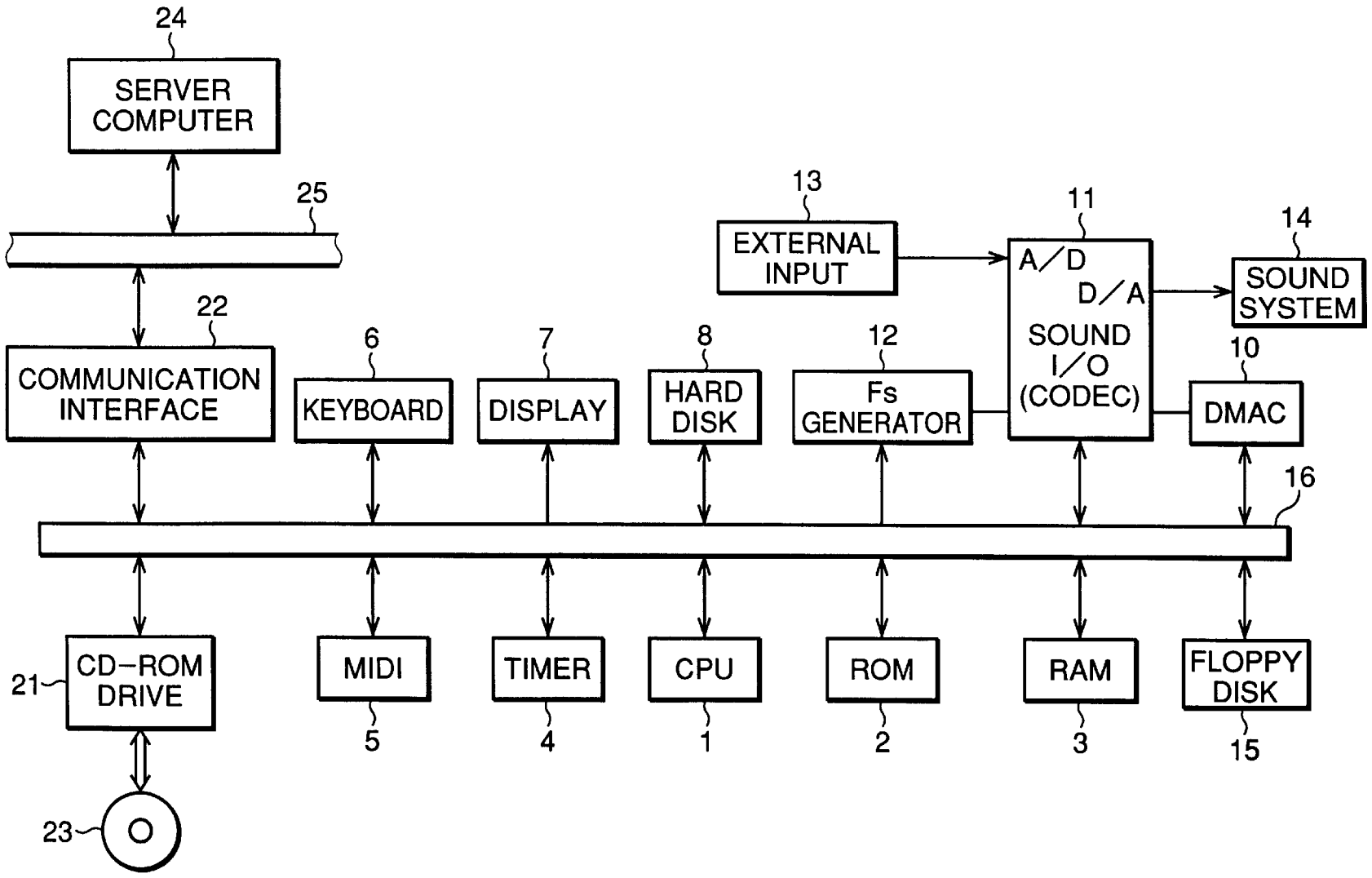
FIG. 9 is a block diagram showing an additional embodiment of the invention.

FIG. 9 shows an additional embodiment of the inventive musical generating apparatus. The apparatus is connected between an input device such as MIDI 5 and a sound system 14 for processing performance information inputted from the input device so as to produce a musical tone signal which is outputted to the sound system 14. The apparatus is implemented by a personal computer composed of CPU 1, ROM 2, RAM 3, HDD (hard disk drive) 8, CD-ROM drive 21, communication interface 22 and so on. The storage such as ROM 2 and HDD 8 can store various data and various programs including an operating system program and an application program which is executed to produce the performance information. Normally, the ROM 2 or HDD 8 provisionally stores these programs. However, if not, any program may be loaded into the musical tone generating apparatus. The loaded program is transmitted to the RAM 3 to enable the CPU 1 to operate the inventive system of the musical tone generating apparatus. By such a manner, new or version-up programs can be readily installed in the system. For this purpose, a machine-readable media such as a CD-ROM (Compact Disc Read Only Memory) 23 is utilized to install the program. The CD-ROM 23 is set into the CD-ROM drive 21 to read out and download the program from the CD-ROM 23 into the HDD 8 through a bus 16. The machine-readable media may be composed of a magnetic disk or an optical disk other than the CD-ROM 23.

The communication interface 22 is connected to an external server computer 24 through a communication network 25 such as LAN (Local Area Network), public telephone network and INTERNET. If the internal storage does not reserve needed data or program, the communication interface 22 is activated to receive the data or program from the server computer 24. The CPU 1 transmits a request to the server computer 24 through the interface 22 and the network 25. In response to the request, the server computer 24 transmits the requested data or program to the musical tone generating apparatus. The transmitted data or program is stored in the storage to thereby complete the downloading.

The inventive musical tone generating apparatus can be implemented by the personal computer which is installed with the needed data and programs. In such a case, the data and programs are provided to the user by means of the machine-readable media such as the CD-ROM 23 or a floppy disk. The machine-readable media contains instructions for causing a machine of the personal computer to perform the inventive method of generating musical tones through a plurality of channels according to performance information by means of a processor placed in either of a working state and an idling state and a buffer connected to the processor. The method comprises the steps of successively producing control information for the plurality of the channels according to the performance information when the same is successively inputted, periodically instituting a regular task of the processor according to the control information for successively executing a routine synthesis of waveform samples of the musical tones allotted to the plurality of the channels and for temporarily storing the waveform samples in the buffer, detecting when the processor occasionally stays in the idling state for instituting an irregular task of the processor to execute an advance synthesis of a waveform sample of a musical tone allotted to a particular one of the channels and for reserving the waveform sample in advance, controlling the processor to skip the routine synthesis of the waveform sample allotted to the particular channel while loading the reserved waveform sample into the buffer, and sequentially reading the waveform samples from the buffer in response to a sampling frequency to generate the musical tones through the plurality of the channels.

Preferably, the method further comprises the step of designating the particular channel which is allotted a musical tone not so affected by the successively inputted performance information as compared to those allotted to other channels such that the reserved waveform sample of the particular channel is generally free of alteration and is normally allowed to be loaded into the buffer. Further, the step of designating comprises designating the particular channel which is allotted a musical tone of a rhythm part rather than a melody part when the performance information is successively inputted to command concurrent generation of the musical tones of parallel parts including the rhythm part and the melody part.

Preferably, the step of controlling further comprises subsequently detecting when the performance information affecting the reserved waveform sample is inputted for canceling loading of the reserved waveform sample into the buffer while instituting the regular task of the processor to execute the routine synthesis of the waveform sample allotted to the particular channel. Further, the step of subsequently detecting comprises detecting when the performance information indicative of a note-off event is inputted subsequently to a note-on event after the waveform sample allotted to the particular channel is reserved for canceling loading of the reserved waveform sample into the buffer while instituting the regular task of the processor to execute the routine synthesis of the waveform sample allotted to the particular channel.

Preferably, the inventive method comprises the step of interruptively operating the processor to institute a multiple of tasks including the routine synthesis of the waveform sample, the successive production of the control information and other application processes not associated to the generation of the musical tones in precedence to the advance synthesis of the waveform sample such that the advance synthesis of the waveform sample is instituted unless the same conflicts the multiple of the tasks. Preferably, the step of periodically instituting comprises successively executing the routine synthesis of the waveform samples of the musical tones allotted to the plurality of the channels in a practical order of priority such that a channel allotted a more significant musical tone precedes another channel allotted a less significant musical tone.

As described and according to the present invention, the musical waveform sample can be generated during advance in the idle time of the CPU, thereby preventing musical tone generation from being discontinued even if many tasks occur at the same time.

While the preferred embodiment of the present invention has been described using specific terms, such description is for illustrative purposes only, and it is to be understood that changes and variations may be made without departing from the spirit or scope of the appended claims.

What is claimed is:

1. A method of generating musical tones through a plurality of channels according to performance information by means of a processor placed in either of a working state and an idling state and a buffer connected to the processor, the method comprising the steps of:

successively producing control information for the plurality of the channels according to the performance information when the same is successively inputted;

periodically instituting a regular task of the processor according to the control information for successively executing a routine synthesis of waveform samples of the musical tones allotted to the plurality of the channels and for temporarily storing the waveform samples in the buffer;

detecting when the processor occasionally stays in the idling state for instituting an irregular task of the processor to execute an advance synthesis of a waveform sample of a musical tone allotted to a particular one of the channels and for reserving the waveform sample in advance;

controlling the processor to skip the routine synthesis of the waveform sample allotted to the particular channel while loading the reserved waveform sample into the buffer; and sequentially reading the waveform samples from the buffer in response to a sampling frequency to generate the musical tones through the plurality of the channels.

2. The method according to claim 1 further comprising the step of designating the particular channel which is allotted a musical tone not so affected by the successively inputted performance information as compared to those allotted to other channels such that the reserved waveform sample of the particular channel is generally free of alteration and is normally allowed to be loaded into the buffer.

3. The method according to claim 2, wherein the step of designating comprises designating the particular channel which is allotted a musical tone of a rhythm part rather than a melody part when the performance information is successively inputted to command concurrent generation of the musical tones of parallel parts including the rhythm part and the melody part.

4. The method according to claim 1, wherein the step of controlling further comprises subsequently detecting when the performance information affecting the reserved waveform sample is inputted for canceling loading of the reserved waveform sample into the buffer while instituting the regular task of the processor to execute the routine synthesis of the waveform sample allotted to the particular channel.

5. The method according to claim 4, wherein the step of subsequently detecting comprises detecting when the performance information indicative of a note-off event is inputted subsequently to a note-on event after the waveform sample allotted to the particular channel is reserved for canceling loading of the reserved waveform sample into the buffer while instituting the regular task of the processor to execute the routine synthesis of the waveform sample allotted to the particular channel.

6. The method according to claim 1 further comprising the step of interruptively operating the processor to institute a multiple of tasks including the routine synthesis of the waveform sample, the successive production of the control information and other application processes not associated to the generation of the musical tones in precedence to the advance synthesis of the waveform sample such that the advance synthesis of the waveform sample is instituted unless the same conflicts the multiple of the tasks.

7. The method according to claim 1, wherein the step of periodically instituting comprises successively executing the routine synthesis of the waveform samples of the musical tones allotted to the plurality of the channels in a practical order of priority such that a channel allotted a more significant musical tone precedes another channel allotted a less significant musical tone.

8. A machine readable media containing instructions for causing a computer machine having a processor placed in either of a working state and an idling state and a buffer connected to the processor to perform a method of generating musical tones through a plurality of channels according to performance information, the method comprising the steps of:

successively producing control information for the plurality of the channels according to the performance information when the same is successively inputted;

periodically instituting a regular task of the processor according to the control information for successively executing a routine synthesis of waveform samples of the musical tones allotted to the plurality of the channels and for temporarily storing the waveform samples in the buffer;

detecting when the processor occasionally stays in the idling state for instituting an irregular task of the processor to execute an advance synthesis of a waveform sample of a musical tone allotted to a particular one of the channels and for reserving the waveform sample in advance;

controlling the processor to skip the routine synthesis of the waveform sample allotted to the particular channel while loading the reserved waveform sample into the buffer; and sequentially reading the waveform samples from the buffer in response to a sampling frequency to generate the musical tones through the plurality of the channels.

9. The machine readable media according to claim 8, wherein the method further comprises the step of designating the particular channel which is allotted a musical tone not so affected by the successively inputted performance information as compared to those allotted to other channels such that the reserved waveform sample of the particular channel is generally free of alteration and is normally allowed to be loaded into the buffer.

10. The machine readable media according to claim 8, wherein the step of controlling further comprises subsequently detecting when the performance information affecting the reserved waveform sample is inputted for canceling loading of the reserved waveform sample into the buffer while instituting the regular task of the processor to execute the routine synthesis of the waveform sample allotted to the particular channel.

11. An apparatus for generating musical tones through a plurality of channels according to performance information, comprising: means for successively producing control information prepared for the plurality of the channels according to the performance information when the same is successively inputted;

processor means placed in either of a working state and an idling state and being operative in the working state for periodically instituting a regular task according to the control information to successively execute a routine synthesis of waveform samples of the musical tones allotted to the plurality of the channels;

buffer means for temporarily storing the waveform samples formed by the routine synthesis;

detector means for detecting when the processor means occasionally stays in the idling state so as to trigger the processor means to institute an irregular task effective to execute an advance synthesis of a waveform sample of a musical tone allotted to a particular one of the channels so that the waveform sample can be reserved in advance;

controller means for controlling the processor means to skip the routine synthesis of the waveform sample allotted to the particular channel while loading the reserved waveform sample into the buffer means; and means for sequentially reading the waveform samples from the buffer means in response to a sampling frequency to generate the musical tones through the plurality of the channels.

12. The apparatus according to claim 11, further comprising means for designating the particular channel which is allotted a musical tone not so affected by the successively inputted performance information as compared to those allotted to other channels such that the reserved waveform sample of the particular channel is generally free of alteration and is normally allowed to be loaded into the buffer means.

13. The apparatus according to claim 11, wherein the controller means further comprises means for subsequently detecting when the performance information affecting the reserved waveform sample is inputted for canceling loading of the reserved waveform sample into the buffer means while instituting the regular task of the processor means to execute the routine synthesis of the waveform sample allotted to the particular channel.

14. The apparatus according to claim 11, wherein the detector means and the controller means are implemented by a computer program which is executed by the processor means.

15. A music apparatus for generating musical tones through a plurality of channels according to performance information, comprising:

an input device that successively produces control information prepared for the plurality of the channels according to the performance information when the same is successively inputted;

a processor that is placed in either of a working state and an idling state and that periodically institutes a regular task in the working state according to the control information to successively execute a routine synthesis of waveform samples of the musical tones allotted to the plurality of the channels;

a buffer memory that is connected to the processor and that temporarily stores the waveform samples formed by the routine synthesis;

a detector that detects when the processor occasionally stays in the idling state and then triggers the processor to institute an irregular task effective to execute an advance synthesis of a waveform sample of a musical tone allotted to a particular one of the channels so that the waveform sample can be reserved in advance;

controller that controls the processor to skip the routine synthesis of the waveform sample allotted to the particular channel while loading the reserved waveform sample into the buffer memory; and an output device that sequentially reads the waveform samples from the buffer memory in response to a sampling frequency to generate the musical tones through the plurality of the channels.

16. The music apparatus according to claim 15, further comprising a designator that designates the particular channel which is allotted a musical tone not so affected by the successively inputted performance information as compared to those allotted to other channels such that the reserved waveform sample of the particular channel is generally free of alteration and is normally allowed to be loaded into the buffer memory.

17. The music apparatus according to claim 15, wherein the controller further comprises a detector that subsequently detects when the performance information affecting the reserved waveform sample is inputted for canceling loading of the reserved waveform sample into the buffer memory while instituting the regular task of the processor to execute the routine synthesis of the waveform sample allotted to the particular channel.

18. The music apparatus according to claim 15, wherein the controller and the detector are implemented by a computer program which is executed by the processor.

* * * * *